US007494373B2

(12) United States Patent
Oketani et al.

(10) Patent No.: US 7,494,373 B2
(45) Date of Patent: Feb. 24, 2009

(54) POWER SOURCE CONNECTION DEVICE AND LOW-TEMPERATURE SHOWCASE INCLUDING THE SAME

(75) Inventors: Tetsuya Oketani, Ota (JP); Shigeo Matsuzawa, Gunma-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 11/798,392

(22) Filed: May 14, 2007

(65) Prior Publication Data

US 2007/0268709 A1 Nov. 22, 2007

(30) Foreign Application Priority Data

May 19, 2006 (JP) ..... 2006-140375

(51) Int. Cl.
*H01R 13/73* (2006.01)

(52) U.S. Cl. ..... 439/546

(58) Field of Classification Search ..... 439/546, 439/548, 549, 556, 135, 136, 148
See application file for complete search history.

(56) References Cited

U.S. PATENT DOCUMENTS

| | | | | | |
|---|---|---|---|---|---|
| 2,604,506 | A * | 7/1952 | Geiger et al. | ..... | 439/546 |
| 3,953,099 | A * | 4/1976 | Wilson | ..... | 439/205 |
| 4,193,655 | A * | 3/1980 | Herrmann, Jr. | ..... | 439/166 |
| 4,310,213 | A * | 1/1982 | Fetterolf et al. | ..... | 439/320 |
| 4,588,247 | A * | 5/1986 | Grappe et al. | ..... | 439/271 |
| 4,593,962 | A * | 6/1986 | Knorreck et al. | ..... | 439/277 |
| 4,653,835 | A * | 3/1987 | Schulte et al. | ..... | 439/557 |
| 4,840,585 | A * | 6/1989 | Muzslay | ..... | 439/556 |
| 4,915,643 | A * | 4/1990 | Samejima et al. | ..... | 439/357 |
| 5,338,211 | A * | 8/1994 | Kodama et al. | ..... | 439/135 |
| 5,580,273 | A * | 12/1996 | Krieger et al. | ..... | 439/546 |
| 5,599,193 | A * | 2/1997 | Crotzer | ..... | 439/66 |
| 5,975,933 | A * | 11/1999 | Yamaguchi et al. | ..... | 439/247 |
| 5,984,691 | A * | 11/1999 | Brodsky et al. | ..... | 439/66 |
| 6,609,917 | B1 * | 8/2003 | Laurandel et al. | ..... | 439/135 |
| 6,722,922 | B2 * | 4/2004 | Cykon et al. | ..... | 439/587 |
| 6,848,938 | B2 * | 2/2005 | Miyamoto | ..... | 439/557 |
| 7,090,533 | B1 * | 8/2006 | Houck et al. | ..... | 439/553 |

FOREIGN PATENT DOCUMENTS

| | | |
|---|---|---|
| JP | 11-273775 | 10/1999 |

* cited by examiner

*Primary Examiner*—Vladimir Imas
(74) *Attorney, Agent, or Firm*—Kratz, Quintos & Hanson, LLP

(57) ABSTRACT

A power source connection device capable of avoiding dropping of a power source plug from a power source socket owing to frost on the power source socket, that has a power source socket attached to a partition plate which separates a showroom of a low-temperature showcase from a cold-air duct; and a power source plug connected to the power source socket, the power source socket has a vessel-like attachment base and an electrode portion formed protruding spaced from an inner portion of an outer peripheral wall constituting the attachment base, the power source plug has a terminal for electrically connecting the power source to the electrode portion and a peripheral wall portion enclosing the terminal, and the power source plug is detachably engaged with the power source socket such that the terminal is connected to the electrode portion of the power source socket.

5 Claims, 8 Drawing Sheets

POWER SOURCE CONNECTION DEVICE AND LOW-TEMPERATURE SHOWCASE INCLUDING THE SAME

BACKGROUND OF THE INVENTION

The present invention relates to a power source connection device of a showcase which supplies power to a fluorescent lamp and the like.

In general, a showcase or the like is provided with a power source connection device including a power source socket connected to the inside of a chamber of a main body of the showcase and a power source plug which is inserted into this power source socket to supply power to a fluorescent lamp and the like. In a conventional power source connection device described in, for example, Japanese Patent Application Laid-Open No. 11-273775, the power source socket is provided with a peripheral wall at an outer periphery thereof, and a recessed portion in which an electrode portion is formed at an inner portion of the peripheral wall. This electrode portion is provided with an insertion port for the power source. On the other hand, the power source plug includes a movable portion which is connected to a wiring line extending to the fluorescent lamp and the like, and a cylindrical portion. A terminal is disposed at a bottom portion of the cylindrical portion. Therefore, to insert the power source plug into the electrode portion of the power source socket, the terminal of the power source-plug is inserted into the insertion port for the power source of the power source socket.

On the other hand, the power source plug connected to the power source connection device is a power source plug of the fluorescent lamp or the like arranged under a front end of each of a plurality of stages of shelves of a shelf device arranged in the chamber. To change an in-chamber layout or the like, an arrangement position of the shelf device is changed. In consequence, the power source socket to which the power source plug is to be connected is changed. Therefore, a plurality of power source sockets are arranged in a vertical direction at a partition plate constituting a back wall of the chamber. However, the power source socket to which the power source plug is connected and the power source socket to which the power source plug is not connected are arranged, depending on a position of the shelf device.

Therefore, the power source socket which is not connected to the power source plug has a problem that, when an in-chamber temperature drops to generate dew condensation water, this dew condensation water enters the electrode portion formed at the power source socket to cause power leakage. To solve the problem, the power source socket constituting the power source connection device described above is rotatably provided with a cap which covers the electrode portion.

However, in the above-mentioned power source connection device, even in a state in which the power source plug is connected to the power source socket, the temperature of the power source socket drops to generate the dew condensation water, because the power source socket is arranged on the partition plate which separates the inside of the chamber and a cold air passage from each other. This dew condensation water turns to frost attached between the power source socket and the power source plug. There is also a problem that, when ice gradually grows, the power source plug drops down from the power source socket. Once the dew condensation water enters between the power source socket and the power source plug to generate the frost, it is difficult to securely attach the power source plug to the power source socket until the frost is removed.

Even in a conventional power source connection device, a protrusion extending in a peripheral direction is formed on an inner circumferential portion of the cylindrical portion of the power source plug, and the power source plug is inhibited from easily dropping down from the power source socket. However, in such a structure, when the power source plug is attached to the power source socket, it cannot be recognized that the terminal of the power source plug has securely been inserted into an appropriate position of the electrode portion of the power source socket. Therefore, the power source plug can be attached to the power source socket only halfway in many cases. In such a case, there has been a problem that the power source plug drops down from the power source socket owing to growth of the attached frost, and there has also been a problem that the power source plug easily drops down from the power source socket owing to a cause other than an influence of the attached frost.

Moreover, in the conventional power source connection device, the cap to cover the electrode portion of the power source socket to which the power source plug is not connected is arranged at the power source socket itself. However, in such a constitution, a constitution of the power source socket itself becomes complicated. Since cap structures are employed in all of the power source sockets, the number of the components increases, and a steep rise of cost might be incurred.

SUMMARY OF THE INVENTION

Therefore, the present invention has been developed in order to solve the conventional technical problems, and an object thereof is to provide a power source connection device capable of avoiding a disadvantage that a power source plug drops down from a power source socket owing to frost which has grown on the power source socket itself.

A power source connection device of a first invention comprises: a power source socket attached to a partition plate which separates a showroom of a low-temperature showcase and a cold-air duct from each other; and a power source plug connected to the power source socket, wherein the power source socket has a vessel-like attachment base and an electrode portion formed so as to protrude at a predetermined interval from an inner portion of an outer peripheral wall constituting the attachment base, the power source plug has a terminal electrically connected to the electrode portion and a peripheral wall portion which encloses the terminal, and the power source plug is detachably engaged with the power source socket in a state in which the terminal is connected to the electrode portion of the power source socket.

In a power source connection device of a second invention, the above invention is characterized in that an outer surface of the peripheral wall portion of the power source plug is provided with an engaging portion which detachably engages with an engaged portion formed on an inner surface of the outer peripheral wall of the power source socket.

In a power source connection device of a third invention, the above invention is characterized in that an outer peripheral surface of the electrode portion of the power source socket or an inner peripheral surface of the peripheral wall portion of the power source plug is provided with a seal material which seals between the peripheral wall portion and the electrode portion.

In a power source connection device of a fourth invention, the above inventions are characterized in that the outer peripheral wall of the power source socket is formed into a double structure having a hollow inner portion.

In a power source connection device of a fifth invention, the above inventions further comprise: a drip-proof cover which covers the electrode portion of the power source socket in a state in which the power source plug is not connected to the power source socket, and are characterized in that the power source socket includes a holding portion which detachably holds the drip-proof cover.

A low-temperature showcase of a sixth invention comprises: the power source connection device according to the above inventions.

According to the first invention, in the power source connection device comprising the power source socket attached to the partition plate which separates the showroom of the low-temperature showcase and the cold-air duct from each other; and the power source plug connected to the power source socket, the power source socket has the vessel-like attachment base and the electrode portion formed so as to protrude at the predetermined interval from the inner portion of the outer peripheral wall constituting the attachment base. Moreover, the power source plug has the terminal electrically connected to the electrode portion and the peripheral wall portion which encloses the terminal. The power source plug is detachably engaged with the power source socket in the state in which the terminal is connected to the electrode portion of the power source socket. Therefore, the power source plug can securely be attached to the power source socket.

Therefore, especially when the power source connection device is used in the low-temperature showcase as in the sixth invention, humidity enters between the power source socket and the power source plug exposed to cold air to attach frost therebetween, and the frost grows into a bulk-like state. Therefore, even when the power source plug is pressed in such a direction as to come off from the power source socket, it is possible to effectively avoid a disadvantage that the power source plug drops down from the power source socket or that a contact defect is generated between the terminal of the power source plug and the electrode portion of the power source socket.

According to the second invention, in the above invention, the outer surface of the peripheral wall portion of the power source plug is provided with the engaging portion which detachably engages with the engaged portion formed on the inner surface of the outer peripheral wall of the power source socket. Therefore, when the engaging portion formed on the outer surface of the peripheral wall portion of the power source plug is engaged with the engaged portion formed on the inner surface of the outer peripheral wall of the power source socket, an attaching operation can be performed while confirming a feeling of engagement between the engaging portion and the engaged portion, and more secure attachment can be realized.

Therefore, the power source plug can securely be attached to the power source socket. Even if the power source plug is pressed in such a direction as to come off owing to growth of the attached frost between the power source plug and the power source socket, it is possible to more securely avoid the disadvantage that the power source plug drops down from the power source socket or that the contact defect is generated between the terminal of the power source plug and the electrode portion of the power source socket.

Furthermore, according to the third invention, in the above invention, the outer peripheral surface of the electrode portion of the power source socket or the inner peripheral surface of the peripheral wall portion of the power source plug is provided with the seal material which seals between the peripheral wall portion and the electrode portion. Therefore, the engagement between the engaging portion formed on the outer surface of the peripheral wall portion of the power source plug and the engaged portion formed on the inner surface of the outer peripheral wall of the power source socket is not interfered. Since the seal material is arranged on the peripheral wall portion of the power source socket or the inner peripheral surface of the peripheral wall portion of the power source plug, it is possible to suppress a disadvantage that humidity or dew condensation water enters even a connecting portion between the electrode portion and the terminal. In consequence, it is possible to prevent a disadvantage that power leakage or the like is caused by entrance of the dew condensation water or the like.

In addition, according to the fourth invention, in the above inventions, the outer peripheral wall of the power source socket is formed into the double structure having the hollow inner portion. Therefore, even when the outer peripheral wall of the power source socket is attached to the low-temperature showcase at a position on a cold-air duct side, the inside of the power source socket can be insulated by the double structure. As compared with a conventional power source socket structure, it is possible to suppress a disadvantage that the dew condensation water is generated in the power source socket or the electrode portion connected to the power source plug.

In consequence, an amount of the dew condensation water to be generated can be reduced, and generation and growth of the frost attached to the inner portion of the outer peripheral wall of the power source socket can remarkably be inhibited. This is preferable for the connection of the power source plug.

According to the fifth invention, the above inventions further comprise: the drip-proof cover which covers the electrode portion of the power source socket in a state in which the power source plug is not connected to the power source socket, and the power source socket includes the holding portion which detachably holds the drip-proof cover. The drip-proof cover is attached to the electrode portion of the power source socket in the state in which the power source plug is not connected to the power source socket. In consequence, it is possible to suppress a disadvantage that the electrode portion of the power source socket is exposed to the cold air and that the dew condensation water enters the power source socket.

Especially, the drip-proof cover is detachably held on the power source socket by the holding portion. In consequence, even when the power source plug is connected to the power source socket for use, the only drip-proof cover does not have to be separately stored, and it is possible to avoid a disadvantage that the drip-proof cover is lost. Furthermore, the drip-proof cover is detachably held by the power source socket. Therefore, when the power source plug is connected to the electrode portion, the cover may be detached from the power source socket, and attached to an electrode portion of another power source socket.

In consequence, the drip-proof covers do not have to be arranged on all of the power source sockets arranged in the low-temperature showcase. Since component costs are reduced and the same member is shared, convenience is improved.

DETAILED DESCRIPTION OF THE PREFERRED EMBODIMENT

A low-temperature showcase 1 to which the present invention is applied will hereinafter be described with reference to the drawings.

Figure 1:
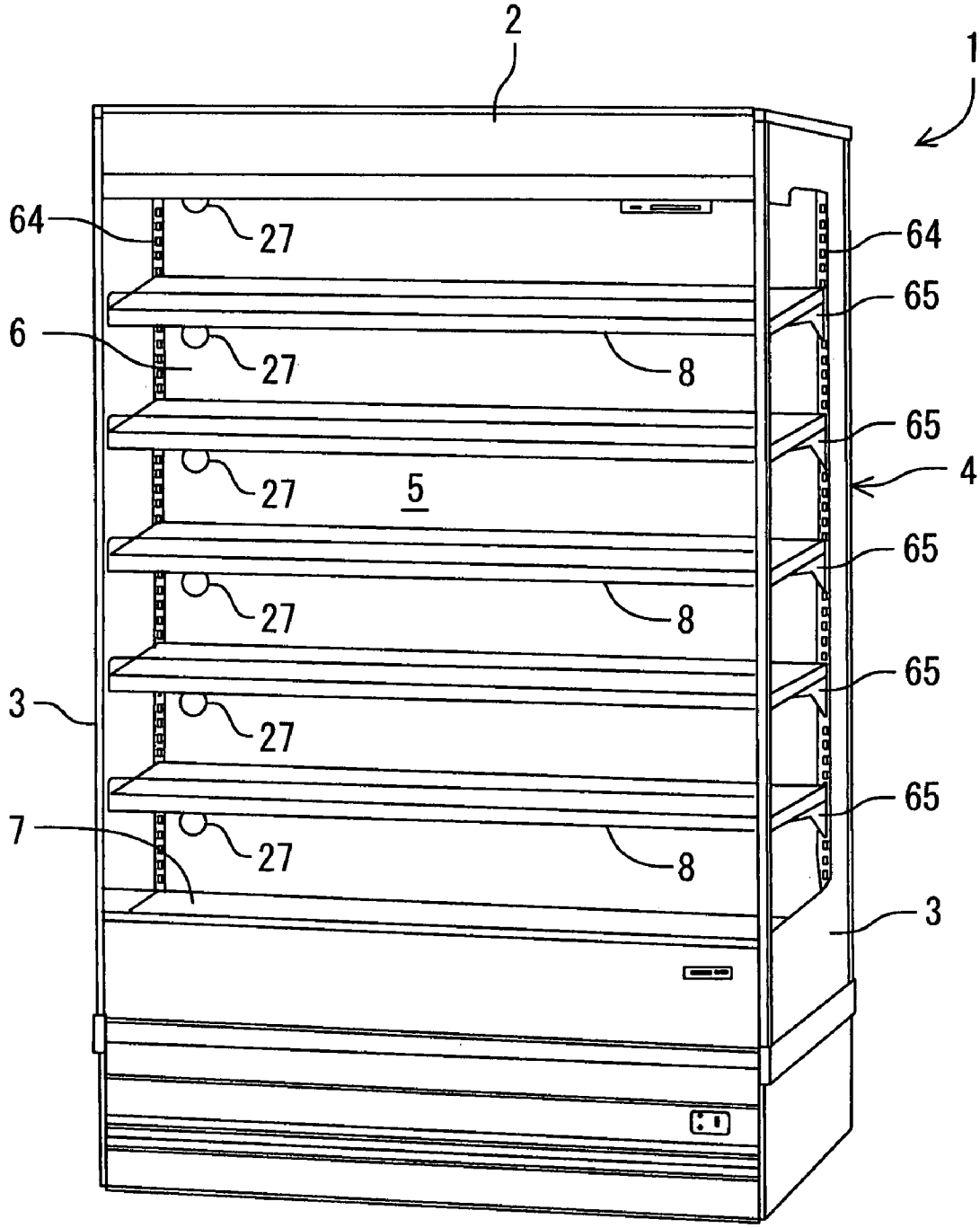
FIG. 1 is a perspective view of a low-temperature showcase according to an embodiment to which the present invention is applied.
Figure 2:
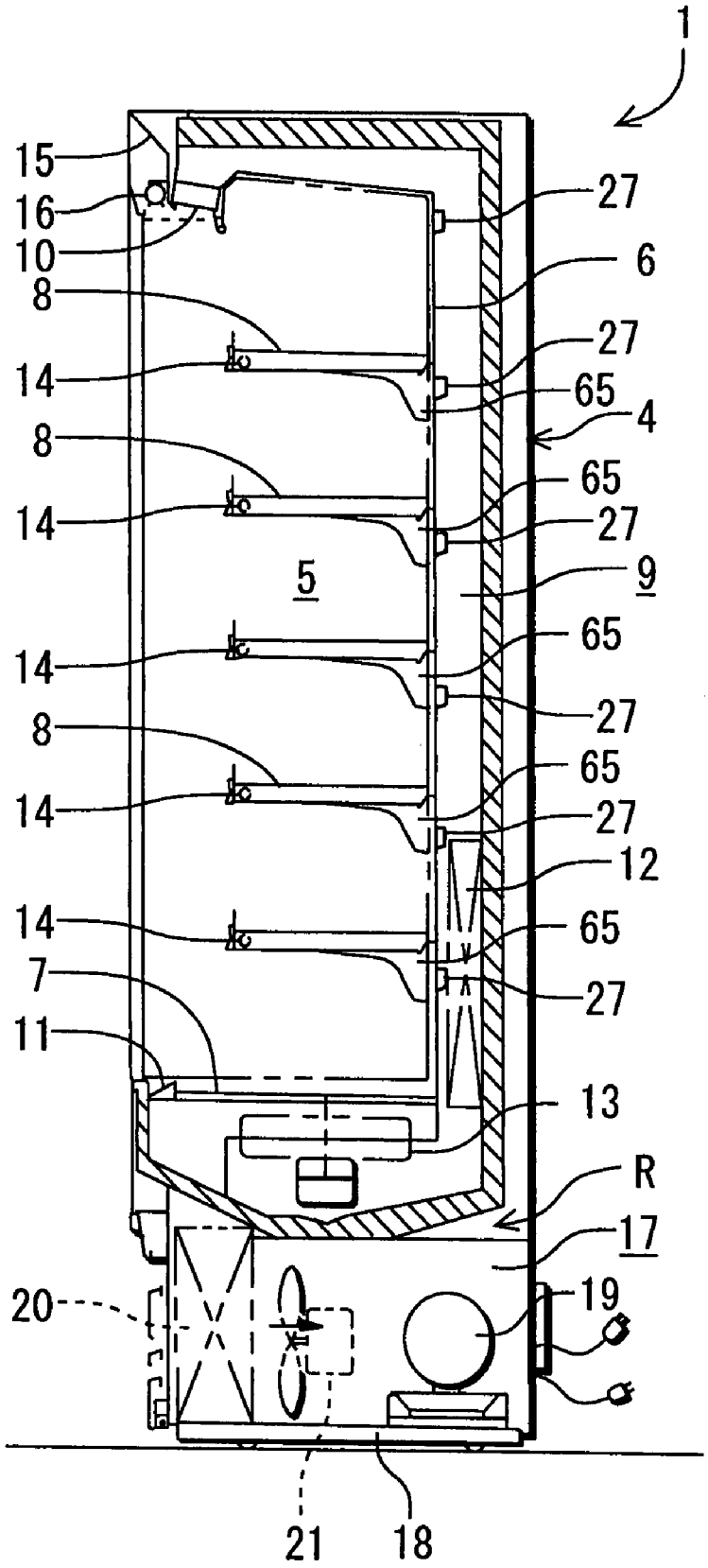
FIG. 2 is a schematic vertical side view of the low-temperature showcase of FIG. 1.

FIG. 1 is a perspective view of the low-temperature showcase 1 to which the present invention is applied, and FIG. 2 is a schematic vertical side view of the low-temperature showcase 1. The low-temperature showcase 1 is installed in a store such as a supermarket or a convenience store, and side plates 3, 3 are attached to opposite sides of an insulating wall 2 having a substantially U-shaped sectional shape to constitute a main body 4. A partition plate 6 and a bottom plate 7 are attached at an interval from an inner part of the insulating wall 2. On an inner side of these plates, a showroom 5 which opens to a front surface is constituted. Moreover, a series of cold-air ducts 9 are constituted between these plates and room and the insulating wall 2.

Moreover, this duct 9 communicates with a discharge port 10 which opens at an upper edge of an opening of the showroom 5 and a suction port 11 which opens at an opening lower edge. The cold-air duct 9 at a back surface is provided with a vertically arranged cooler 12 included in a cooling unit R, and a blower 13 is installed in the cold-air duct 9 under the bottom plate 7.

In the showroom 5, a plurality of stages of shelves 8 . . . are arranged in a vertical direction. This shelf 8 is held by supports 64 arranged in the showroom 5 via left and right brackets 65, 65 attached to the supports. Each support 64 is provided with a plurality of engagement holes arranged in the vertical direction. A position of each shelf 8 extended between the supports 64 via engaging claws (not shown) formed at rear ends of the brackets 65 can arbitrarily be changed. Moreover, illuminative lamps 14 are detachably attached to lower surfaces of the shelves 8 in order to illuminate commodities on each shelf 8 arranged under the lamp and a front part of the showroom 5.

Moreover, a canopy 15 is disposed at an upper edge of an opening of a front surface of the insulating wall 2, and positioned in front of the discharge port 10. An illuminative lamp 16 which illuminates the inside of the showroom 5 and a part around the showroom 5 from above is attached to a lower part of the canopy 15.

On the other hand, a machine room 17 is formed under the insulating wall 2, and a unit base 18 is arranged in the machine room 17. Above the unit base 18, a compressor 19, a condenser 20 and a blower 21 for the condenser included in the cooling unit R are arranged in the machine room 17.

According to the above constitution, when the blower 13 is operated, cold air subjected to heat exchange between the air and the cooler 12 is raised in the duct 9, and discharged into the showroom 5 from the discharge port 10. Moreover, the cold air sucked from the suction port 11 is again accelerated by the blower 13, and the cold air is circulated through the showroom 5 to cool the inside of the showroom 5 at a predetermined temperature.

Figure 3:
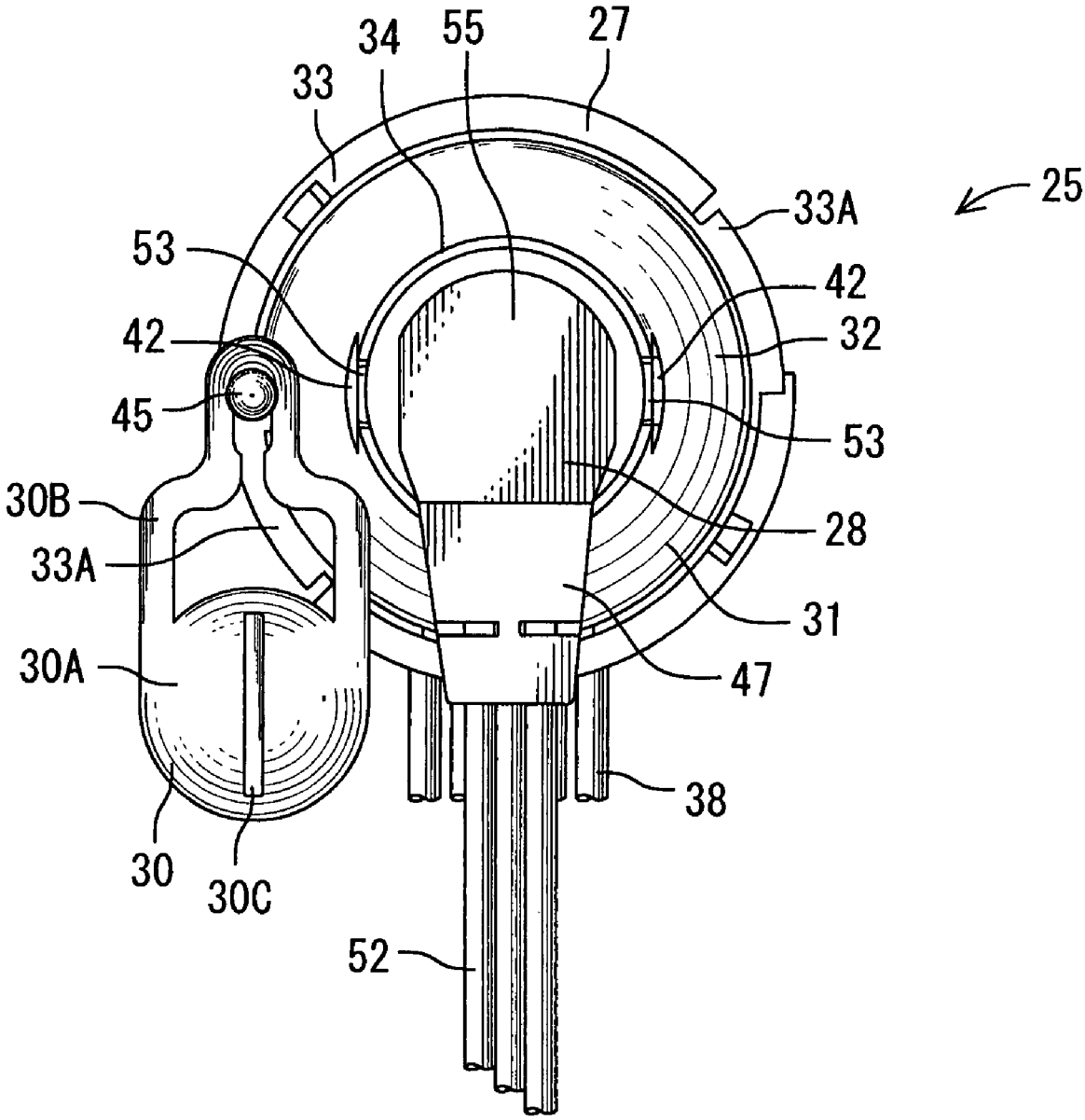
FIG. 3 is a plan view of a power source connection device according to one embodiment of the present invention.
Figure 4:
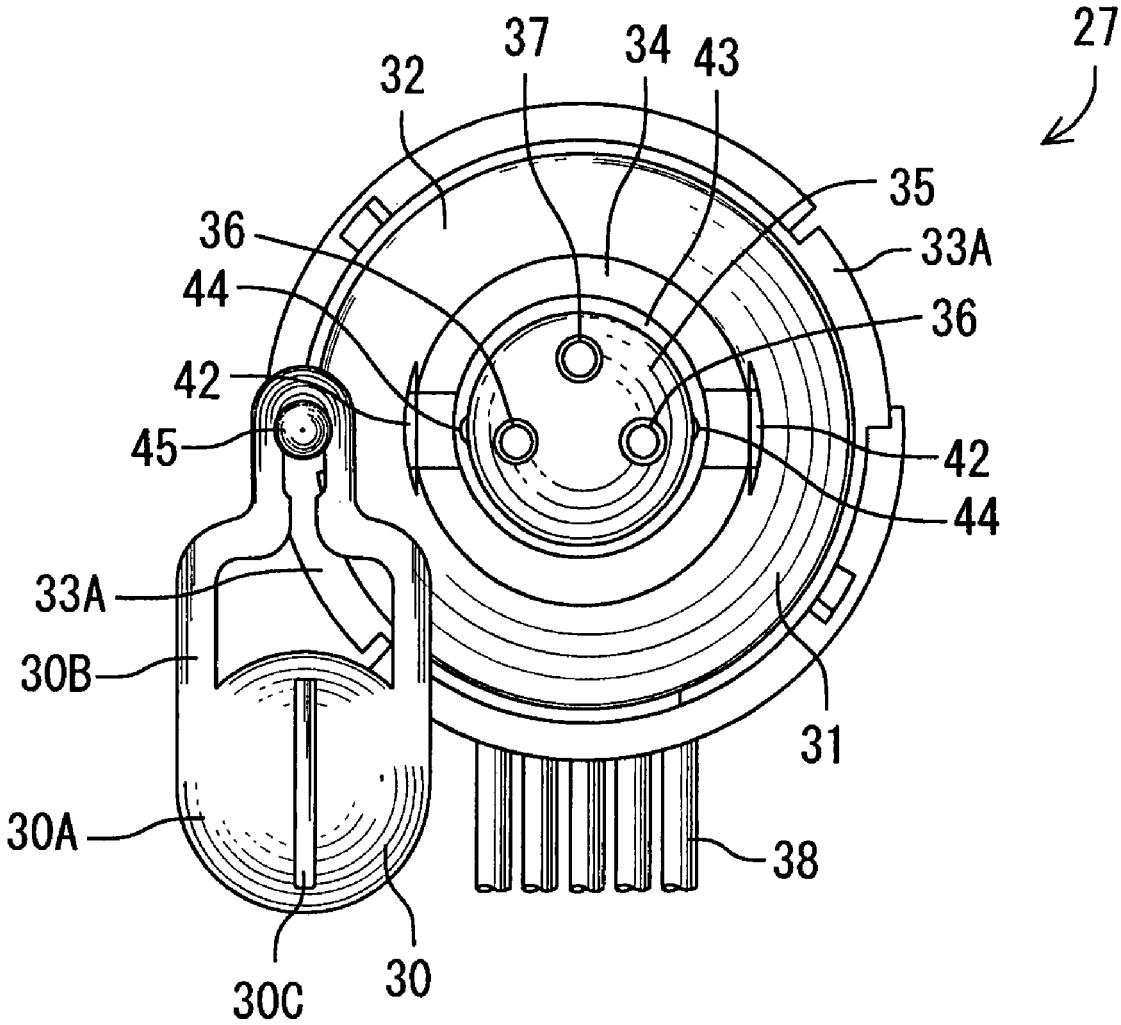
FIG. 4 is a front view of a power source socket of the power source connection device shown in FIG. 3.
Figure 5:
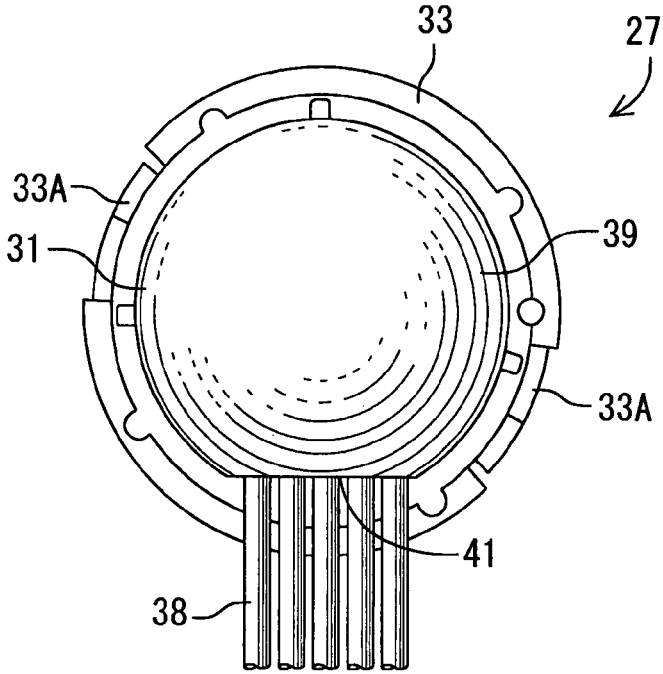
FIG. 5 is a back view of the power source socket of FIG. 4.
Figure 6:
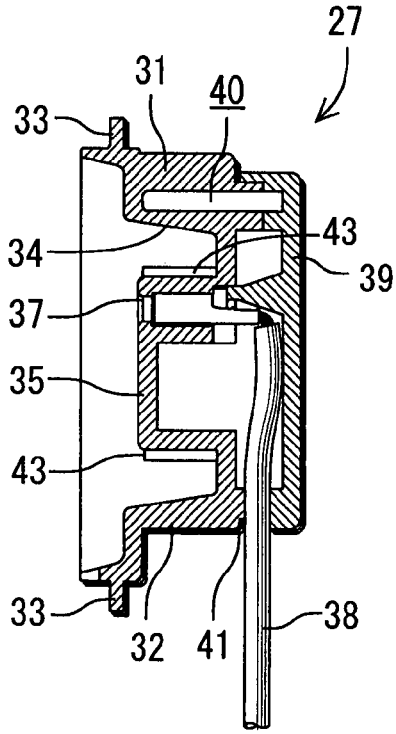
FIG. 6 is a vertical side view of the power source socket of FIG. 4.
Figure 7:
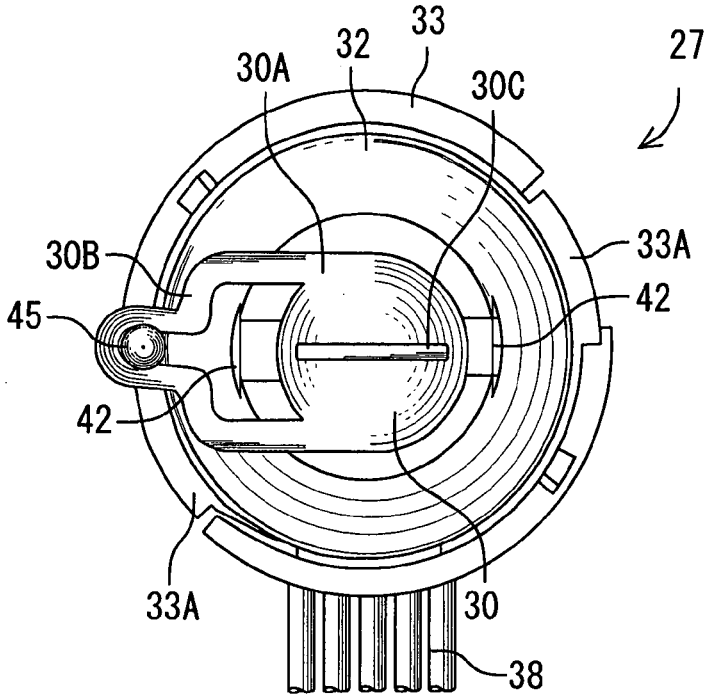
FIG. 7 is a front view showing that a drip-proof cover is attached to the power source socket of FIG. 4.
Figure 8:
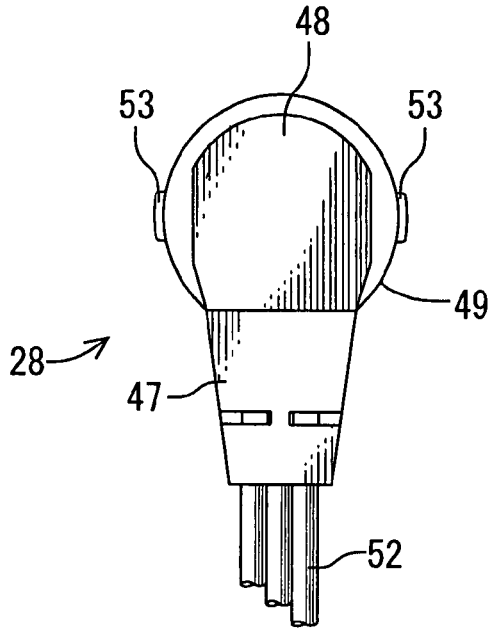
FIG. 8 is a front view of a power source plug of the power source connection device of FIG. 3.
Figure 9:
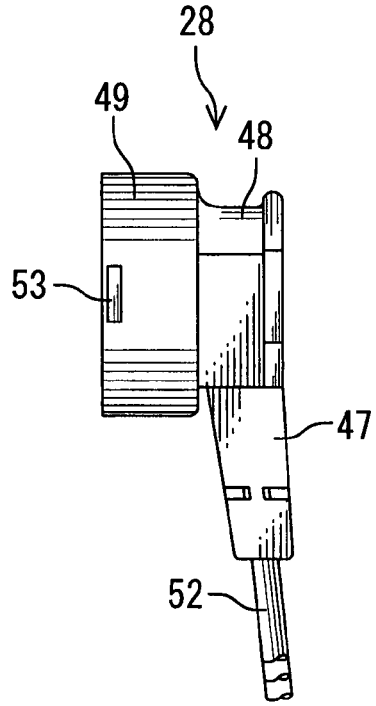
FIG. 9 is a side view of the power source plug of FIG. 8.
Figure 10:
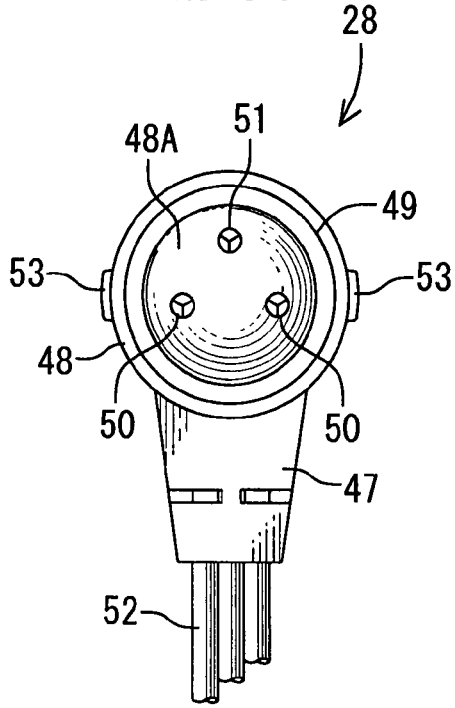
FIG. 10 is a back view of the power source plug of FIG. 8.
Figure 11:
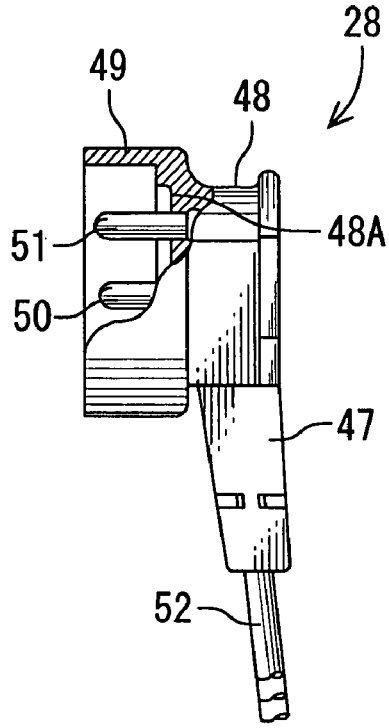
FIG. 11 is a partially cut side view of the power source plug of FIG. 8.
Figure 12:
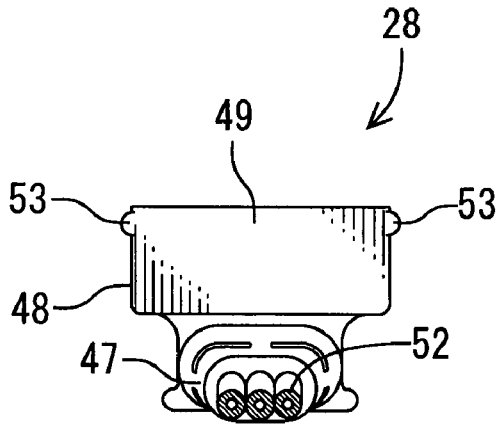
FIG. 12 is a plan view of the power source plug of FIG. 8 viewed from below.

Next, a power source connection device 25 of the present invention will be described in detail with reference to FIGS. 3 to 12. FIG. 3 is a plan view of the power source connection device 25; FIG. 4 is a front view of a power source socket 27; FIG. 5 is a back view of the power source socket 27; FIG. 6 is a vertical side view of the power source socket 27; FIG. 7 is a front view showing that a drip-proof cover 30 is attached to the power source socket 27; FIG. 8 is a front view of a power source plug 28; FIG. 9 is a side view of the power source plug 28; FIG. 10 is a back view of the power source plug 28; FIG. 11 is a partially cut side view of the power source plug 28; and FIG. 12 is a plan view of the power source plug 28 viewed from below.

The power source connection device 25 of the present embodiment is a device which supplies power to the illuminative lamps 14, 16 for use in illuminating the inside of the showroom 5 of the low-temperature showcase 1 as described above. The device includes the power source socket 27 arranged at the partition plate 6 constituting the back surface of the showroom 5 of the low-temperature showcase 1, and the power source plug 28 inserted into the power source socket 27 to supply the power to the illuminative lamp 14 or 16. In the present embodiment, since the power source connection device 25 is arranged for each of the illuminative lamps 14, 16. Therefore, a plurality of power source sockets 27 are arranged in the vertical direction at the partition plate 6. For example, the power source sockets 27 are arranged along the supports 64 as many as the illuminative lamps 14 or more than the illuminative lamps.

As shown in FIGS. 4 and 6, the power source socket 27 includes a vessel-like attachment base 31, and the attachment base 31 is made of a hard synthetic resin or the like. An outer peripheral wall 32 constituting the attachment base 31 has a double structure constituting a hollow inner portion 40 over an outer periphery excluding a drawing portion of a lead wire described later, and an outwardly directed flange 33 is formed on an end portion of the outer peripheral wall 32. This outwardly directed flange 33 is provided with fixing claws 33A which are positioned closer to an end surface than to the outwardly directed flange 33 and which nip the partition plate 6. A recessed portion 34 is formed internally from the outer peripheral wall 32.

At a bottom portion of this recessed portion 34, an electrode portion 35 is formed so as to protrude at a predetermined interval from an inner wall of the outer peripheral wall 32. This electrode portion 35 is provided with two insertion ports 36 for the power source and one insertion port 37 for ground. The insertion ports 36 for the power source and the insertion port 37 for ground are electrically connected to corresponding lead wires 38 from a bottom portion side of the recessed portion 34. The lead wires 38 connected to the insertion ports 36, 37 are drawn outwardly from a lead wire drawing portion 41 formed on the outer peripheral wall 32, and the bottom portion of the recessed portion 34 is blocked with a blocking member 39 detachably attached to the recessed portion. It is to be noted that the double structure constituting the hollow inner portion 40 of the outer peripheral wall 32 on a bottom portion side as described above is blocked with the blocking member 39.

Moreover, an annular seal material 43 is attached to an outer peripheral surface of this electrode portion 35, and stoppers 44 are formed at end portions of the electrode portion 35 so as to slightly protrude toward the outer peripheral wall 32 of the power source socket 27 in order to prevent the attached seal material 43 from easily dropping down.

Furthermore, on an inner surface of the outer peripheral wall 32 of the power source socket 27, that is, a side wall constituting the recessed portion 34, engaged portions 42, 42 are formed which are to be detachably engaged with engaging portions 53 formed on the power source plug 28 as described later in detail. Each engaged portion 42 is formed at a predetermined interval from a bottom wall of the recessed portion 34 so as to slightly protrude inwards, that is, toward the electrode portion 35. It is to be noted that each gap between each engaged portion 42 and the seal material 43 has a dimension slightly larger than a thickness dimension of a peripheral wall portion 49 of the power source plug 28 described later. In the present embodiment, the engaged portions 42 are formed at two portions which face each other.

In addition, a drip-proof cover holding portion 45 provided with a flange at an end portion thereof is attached to an end portion of the outer peripheral wall 32 of the power source socket 27, and the drip-proof cover 30 is detachably held by the drip-proof cover holding portion 45. This drip-proof cover 30 includes a cover portion 30A which covers an end surface of the electrode portion 35 provided with the insertion ports 36 for the power source and the insertion port 37 for ground, and an engaging portion 30B formed integrally with the cover portion 30A.

The cover portion 30A is provided with protrusions corresponding to the insertion ports 36 for the power source and the insertion port 37 for ground on a rear surface of the cover portion. At a front surface of the cover portion, a tab 30C is formed so as to perform an operation of detachably attaching the cover portion 30A. The engaging portion 30B is provided with an opening engageable with the drip-proof cover holding portion 45 via a constricted portion and an opening to release the engagement with the drip-proof cover holding portion 45. While the engaging portion 30B is deformed, the drip-proof cover holding portion 45 is moved from the opening which is engageable with the drip-proof cover holding portion to the opening to release the engagement with the drip-proof cover holding portion 45, or from the opening to release the engagement to the engageable opening. In consequence, the drip-proof cover 30 can be detached from the power source socket 27. The opening which is engageable with the drip-proof cover holding portion 45 is formed to be slightly larger than the drip-proof cover holding portion 45. In a state in which the engaging portion 30B is engaged with the drip-proof cover holding portion 45, the drip-proof cover 30 is rotatable.

On the other hand, the power source plug 28 connected to the electrode portion 35 of the power source socket 27 includes a movable portion 47 and a cylindrical operation 48 having the peripheral wall portion 49 which are molded of a synthetic resin or the like. As shown in FIG. 10, a bottom portion 48A positioned inwardly from this cylindrical operation 48 is provided with two terminals 50 for the power source and one terminal 51 for ground. The terminals 50 and the like are enclosed with the peripheral wall portion 49 constituting the cylindrical operation 48. These terminals 50 for the power source and the terminal 51 for ground are electrically connected to power supply wires 52 of the illuminative lamps 14, 16 attached to the inside of the showroom 5.

Moreover, the engaging portions 53, 53 which detachably engage with the engaged portions 42, 42 of the power source socket 27 as described above are formed at end portions of an outer surface of the peripheral wall portion 49 of the power source plug 28. In a state in which the engaging portions 53 are attached to the outside, that is, the power source socket 27, the engaging portions are formed so as to slightly protrude toward the inner surface of the outer peripheral wall 32 of the power source socket 27. It is assumed that the engaging portions 53 are formed of such a material that the peripheral wall portion 49 itself is deformable. It is to be noted that in the present embodiment, the engaging portions are formed at two portions which face each other so as to correspond to the engaged portions 42.

According to such a constitution, when the power source socket 27 is mounted on the partition plate 6 as described above, the power source socket 27 is protruded from the showroom 5 side toward the cold-air duct 9, and attached to a hole (not shown) for the socket which is formed beforehand in the partition plate 6. The partition plate 6 is nipped by the fixing claws 33A and the outwardly directed flange 33 of the power source socket 27, and the power source socket 27 is fixed to the partition plate 6. In consequence, the attachment base 31 of the power source socket 27 on an opening side, that is, the power source plug 28 on a connection side is positioned on a showroom 5 side, and the recessed portion 34 on a bottom portion side is positioned on a cold-air duct 9 side.

To connect the power source plug 28 to the electrode portion 35 of suck a power source socket 27, when the electrode portion 35 is covered with the drip-proof cover 30, the drip-proof cover 30 is detached from the electrode portion 35 to expose the electrode portion 35, and the terminals 50 for the power source and the terminal 51 for ground of the power source plug 28 are inserted into the insertion ports 36 for the power source and the insertion port 37 for ground of the power source socket 27, respectively.

At this time, the peripheral wall portion 49 of the power source plug 28 is inserted into the recessed portion 34 of the power source socket 27 so as to surround the electrode portion 35 of the power source socket 27 with the peripheral wall portion 49, and the engaging portions 53, 53 formed at the end portions of the outer surface of the peripheral wall portion 49 of the power source plug 28 are engaged with the engaged portions 42, 42 formed on the inner surface of the outer peripheral wall 32 of the power source socket 27. At this time, since at least the peripheral wall portion 49 of the power source plug 28 provided with the engaging portions 53 is formed of a deformable material, the peripheral wall portion is deformed by such a force as to push the power source plug 28 into the power source socket 27. In consequence, when the engaging portions 53, 53 ride over the engaged portions 42, 42, the engaging portions 53 are engaged with the engaged portions 42. Therefore, in a state in which the terminals 50 for the power source and the terminal 51 for ground of the power source plug 28 are connected to the electrode portion 35 of the power source socket 27, the power source plug 28 is securely attached to the power source socket 27.

Therefore, even when the power source connection device 25 is attached to the low-temperature showcase 1 as in the present embodiment, humidity enters between the power source socket 27 and the power source plug 28 which are exposed to the cold air to attach frost therebetween, and the frost grows into a bulk-like state. Therefore, even when the power source plug 28 is pressed in such a direction as to come off from the power source socket 27, the engaging portions 53 of the power source plug 28 are securely engaged with the engaged portions 42 of the power source socket 27. Therefore, it is possible to avoid a disadvantage that the power source plug 28 drops down from the power source socket 27 or that a contact defect is generated between the terminals 50 for the power source and the terminal 51 for ground of the power source plug 28 and the electrode portion 35 of the power source socket 27.

Especially, in the present embodiment, the engaging portions 53 formed on the end portions of the outer surface of the peripheral wall portion 49 of the power source plug 28 ride over the engaged portions 42 formed at the inner surface of the outer peripheral wall 32 of the power source socket 27, and are engaged with the engaged portions. Therefore, an operator can connect the power source plug 28 to electrode portion 35 of the power source socket 27 while confirming a feeling of engagement between the engaging portions 53 and the engaged portions 42. In consequence, it is possible to realize secure attachment, and it is possible to avoid the generation of a connection defect in advance.

In addition, even according to the constitution, even when the power source plug 28 is pressed in such a direction as to come off owing to the growth of the attached frost between the power source plug 28 and the power source socket 27, it is possible to more securely avoid a disadvantage that the power source plug 28 drops down from the power source socket 27 or that a contact defect is generated between the terminals 50 for the power source of the power source plug 28 and the like and the electrode portion 35 of the power source socket 27.

Moreover, since the outer peripheral surface of the electrode portion 35 of the power source socket 27 of the present embodiment is provided with the seal material 43, it is possible to securely seal between the inner peripheral surface of the peripheral wall portion 49 of the power source plug 28 and the outer peripheral surface of the electrode portion 35 in a state in which the power source plug 28 is attached to the electrode portion 35. Therefore, when the inside of the showroom 5 is cooled for use, the power source socket 27 and the power source plug 28 are cooled to attach dew condensation water therebetween. Even in this case, a disadvantage that the dew condensation water and humidity enter between the inner peripheral surface of the peripheral wall portion 49 of the power source plug 28 and the electrode portion 35 can be suppressed. Therefore, it is possible to avoid a disadvantage that the humidity and dew condensation water enter connecting portions between the electrode portion 35 and the terminals 50 for the power source. A disadvantage of generation of power leakage or the like can be prevented.

It is to be noted that in the present embodiment, the engaging portions 53 and the engaged portions 42 which engage the power source plug 28 with the power source socket 27 are formed on the outer surface of the peripheral wall portion 49 of the power source plug 28 and the inner surface of the outer peripheral wall 32 of the power source socket 27, respectively. Therefore, it is possible to avoid a disadvantage that the seal material 43 attached between the outer peripheral surface of the electrode portion 35 and the inner peripheral surface of the power source plug 28 interferes with the engagement between the engaging portions 53 and the engaged portions 42.

In consequence, it is possible to more appropriately establish electric connection between the electrode portion 35 and the terminals 50 for the power source of the power source plug 28. Especially, the present invention is remarkably useful in an environment where the power source socket 27 and the power source plug 28 are cooled, for example, a case where the power source connection device is used in the low-temperature showcase 1 or the like as in the present embodiment.

It is to be noted that in the present embodiment, the seal material 43 is attached to the outer peripheral surface of the electrode portion 35 of the power source socket 27, but the present invention is not limited to this embodiment. Even if the seal material is arranged on the inner peripheral surface of the peripheral wall portion 49 of the power source plug 28, a similar effect can be obtained.

Moreover, in the present embodiment, since the power source socket 27 is attached to the partition plate 6, the attachment base 31 on the opening side, that is, the power source plug 28 on the connection side is positioned on the showroom 5 side, and the recessed portion 34 on the bottom portion side is positioned on the cold-air duct 9 side. However, as described above, the outer peripheral wall 32 of the power source socket 27 is formed into the double structure having the hollow inner portion 40. Therefore, the inside of the power source socket 27 can be insulated with the double structure. As compared with a conventional power source socket structure, the temperature does not easily drop at the inner part of the power source socket 27 and the electrode portion 35 connected to the power source plug 28 owing to the cold air circulated through the cold-air duct 9, and the generation of the dew condensation water can be suppressed.

In consequence, an amount of the dew condensation water to be generated can be reduced. Therefore, the generation and the growth of the frost attached to the inner part of the outer peripheral wall 32 of the power source socket 27 can remarkably be inhibited. The constitution is preferable for the connection of the power source plug 28.

It is to be noted that, in a case where a layout in the showroom 5 is changed by changing the attachment positions of the shelves 8 arranged in the showroom 5 or adding or removing the shelf, an existing connection position of the power source plug 28 to the power source socket 27 is changed. In this case, there are the power source socket 27 to which the power source plug 28 is connected, and the power source socket 27 to which any power source plug is not connected.

In such a case, when the power source plug 28 is not connected to the power source socket 27, the surface of the electrode portion 35 provided with the insertion ports 36 and 37 is covered with the drip-proof cover 30 arranged on the power source socket 27 via the drip-proof cover holding portion 45. In consequence, even when the power source plug 28 is not connected to the power source socket, it is possible to avoid disadvantages that the electrode portion 35 is exposed to the cold air and that the dew condensation water and the like enter the electrode portion 35. The generation of power leakage or the like can be avoided in advance.

Especially, the drip-proof cover 30 is detachably held on the power source socket 27 by the drip-proof cover holding portion 45. Therefore, even when the power source plug 28 is connected to the power source socket 27 for use, the drip-proof cover 30 remains to be held by the drip-proof cover holding portion 45, The only drip-proof cover 30 does not have to be separately stored. In consequence, it is possible to avoid a disadvantage that the drip-proof cover 30 is lost.

Furthermore, the drip-proof cover 30 is detachably held by the power source socket 27. Therefore, when the power source plug 28 is connected to the electrode portion 35, the cover is detached from the power source socket 27, and may be attached to the electrode portion 35 of another power source socket 27.

In consequence, the drip-proof cover 30 does not have to be arranged on all of the power source sockets 27 arranged in the low-temperature showcase 1. Since component costs are reduced and the same member is shared, convenience is improved.

It is to be noted that it has been described in the present embodiment that the power source plug 28 is for use in supplying the power to the illuminative lamps 14, 16 arranged in the showroom 5, but the present invention is not limited to this embodiment. Even if the plug is for use in supplying power to another electric device, a similar effect can be produced.

The invention claimed is:

1. A power source connection device comprising: a power source socket attached to a partition plate which separates a showroom of a low-temperature showcase and a cold-air duct from each other; and a power source plug connected to the power source socket, wherein the power source socket has a vessel-like attachment base and an electrode portion formed so as to protrude at a predetermined interval from an inner portion of an outer peripheral wall constituting the attachment base, the power source plug has a terminal electrically connected to the electrode portion and a peripheral wall portion which encloses the terminal, and the power source plug is detachably engaged with the power source socket in a state in which the terminal is connected to the electrode portion of the power source socket, wherein an outer surface of the peripheral wall portion of the power source plug is provided with an engaging portion which detachably engages with an engaged portion formed so as to protrude inwards from an inner surface of the outer peripheral wall of the power source socket, such that the engaging portion rides over the engaged portion to securely attach the power source plug with the power source socket.

2. The power source connection device according to claim 1, wherein an outer peripheral surface of the electrode portion of the power source socket or an inner peripheral surface of the peripheral wall portion of the power source plug is provided with a seal material which seals between the peripheral wall portion and the electrode portion.

3. The power source connection device according to any one of claims 1 and 2, wherein the outer peripheral wall of the power source socket is formed into a double structure having a hollow inner portion.

4. The power source connection device according to any one of claims 1 and 3, further comprising:

a drip-proof cover which covers the electrode portion of the power source socket in a state in which the power source plug is not connected to the power source socket, wherein the power source socket includes a holding portion which detachably holds the drip-proof cover.

5. A low-temperature showcase comprising: the power source connection device according to any one of claims 1 and 3.

* * * * *